US008810343B2

(12) United States Patent
Kellner

(10) Patent No.: US 8,810,343 B2
(45) Date of Patent: Aug. 19, 2014

(54) RELAY HAVING A MODIFIED FORCE-DISPLACEMENT CHARACTERISTIC

(71) Applicant: Hengstler GmbH, Aldingen (DE)

(72) Inventor: Jozef Kellner, Vlkovce (SK)

(73) Assignee: Hengstler GmbH, Aldingen (DE)

( * ) Notice: Subject to any disclaimer, the term of this patent is extended or adjusted under 35 U.S.C. 154(b) by 0 days.

(21) Appl. No.: 13/966,677

(22) Filed: Aug. 14, 2013

(65) Prior Publication Data

US 2014/0062624 A1 Mar. 6, 2014

(30) Foreign Application Priority Data

Aug. 30, 2012 (DE) ..... 10 2012 017 157

(51) Int. Cl.
*H01H 67/00* (2006.01)

(52) U.S. Cl.
USPC ..... 335/106; 335/129

(58) Field of Classification Search
USPC ..... 335/106, 129, 178, 180
See application file for complete search history.

(56) References Cited

U.S. PATENT DOCUMENTS

| | | | | | |
|---|---|---|---|---|---|
| 977,140 | A | * | 11/1910 | Sibole | 335/126 |
| 2,312,493 | A | * | 3/1943 | Sengebusch | 335/129 |
| 2,894,095 | A | * | 7/1959 | Wijkman | 335/129 |
| 3,270,301 | A | * | 8/1966 | Bengtsson | 335/129 |
| 5,053,756 | A | * | 10/1991 | Wehrle et al. | 335/128 |
| 5,111,171 | A | * | 5/1992 | von Bonin et al. | 335/202 |
| 5,568,108 | A | * | 10/1996 | Kirsch | 335/130 |
| 5,831,502 | A | * | 11/1998 | Kirsch | 335/129 |
| 5,945,900 | A | * | 8/1999 | Shibata et al. | 335/234 |
| 6,034,582 | A | * | 3/2000 | Fausch | 335/78 |
| 6,300,854 | B1 | | 10/2001 | Oberndorfer | |
| 6,906,604 | B1 | * | 6/2005 | Mader et al. | 335/129 |
| 7,504,915 | B2 | * | 3/2009 | Takayama et al. | 335/78 |
| 7,633,363 | B2 | * | 12/2009 | Fausch | 335/129 |
| 8,159,321 | B2 | * | 4/2012 | Bollinger et al. | 335/132 |
| 8,564,388 | B2 | * | 10/2013 | Hirao et al. | 335/185 |

FOREIGN PATENT DOCUMENTS

| | | | |
|---|---|---|---|
| DE | 2541650 | C3 | 3/1977 |
| DE | 3037859 | A1 | 4/1981 |
| DE | 19600314 | A1 | 7/1997 |
| DE | 19858755 | C1 | 6/2000 |
| DE | 10158023 | A1 | 6/2003 |
| DE | 202004011488 | U1 | 9/2004 |
| EP | 1121700 | B2 | 8/2001 |
| EP | 1121700 | B1 | 6/2002 |
| EP | 1681699 | A1 | 7/2006 |

OTHER PUBLICATIONS

European Search Report for Appln. No. 13003538.9-1808 dated Dec. 16, 2013.

* cited by examiner

*Primary Examiner* — Shawki S Ismail
*Assistant Examiner* — Lisa Homza
(74) *Attorney, Agent, or Firm* — Browdy and Neimark, PLLC

(57) ABSTRACT

An electromagnetic relay including at least one contact-set support in which a plurality of contact springs are fixed at the base end and, in pairs, form normally open and/or normally closed contacts, wherein at least one actuator acts on each active contact spring, the actuator being movably driven in the longitudinal direction thereof by a magnet system and having actuating surfaces for acting on the respective contact spring to be actuated, the actuating surfaces assigned to each of the active contact springs forming an angle with the direction of actuation of the actuator.

13 Claims, 5 Drawing Sheets

RELAY HAVING A MODIFIED FORCE-DISPLACEMENT CHARACTERISTIC

FIELD

The invention relates to a relay having a modified force-displacement characteristic having at least one contact-set support in which a plurality of contact springs are fixed at the base end and, in pairs, form normally open and/or normally closed contacts, wherein at least one actuator acts on the respective active contact springs.

BACKGROUND

One relay has become known, for example, with the subject matter of EP 1 121 700 B2. This relay discloses a matching of the force-displacement characteristic to the drive characteristic in such a way that the actuator operates in two different actuation planes. That is to say, the actuator for the normally dosed contacts is in a different horizontal plane than, by comparison, the actuator for the normally open contacts. On movement of the actuator, the normally dosed contact opens first, before the normally open contact is dosed via an offset movement. This means that the force required by the actuation of the normally open contacts must be applied by the drive with delayed movement. This has the effect that the force-displacement characteristic of the contact set is modified. This provides the advantage that the drive characteristic and the contact-set characteristic are being matched to one another.

From the cited printed publication it follows that, in the normal state, the actuator is located, for example, at a certain point s1 (or to the right thereof) according to FIG. 7 of said printed publication, the point s1 being dependent on the degree of contact erosion. On attraction of the armature, the actuator moves to the left, with the force m of the magnet system initially increasing only slowly. However, in this region, up to a point s2, the actuating force required to overcome the normally-closed contact force (at the active normally-closed contact spring or at the anchor spring adapted thereto) is still relatively low as well, because of the large mechanical advantage.

From a point s2 to s3, a greater increasing restoring force is created by the added action of the active normally-open contact springs, which restoring force is overcome by a magnetic force m of the drive system that likewise increases more strongly in this region. From a point s3 to the mutual abutment of the contacts, both the restoring force f and the magnetic force increase substantially. This is the region of the overtravel, which continues to a point s4. The figures mentioned refer to FIG. 7 of EP 1 121 700 B2 and to FIG. 8 of the present invention, in which FIG. 7 of the cited printed publication has been plotted as prior art.

It is therefore the object of said printed publication to match the force-displacement characteristic or—as it is better termed in the description below, the contact-set characteristic, —to the discontinuous operating stroke (drive characteristic) of the magnet system.

In particular, the contact-set characteristic should not intersect with the drive characteristic of the magnet system, as this would result in unstable actuator travel, and speedy, smooth and continuous actuation of the contact set would no longer be ensured.

The printed publication cited solves this problem of the modification or modeling of the contact-set characteristic against a constant, consistent drive characteristic in such a way that the actuator acts on the contact set in two different planes.

In said printed publication, the points of contact engagement by the actuator on the associated contacts are dedicated and remain at a fixed, unchangeable distance from each other during the actuator travel. The mechanical advantage therefore is fixed. This means the distance between the point of fixation of each spring and the plane of actuation of this spring. A change-over from one plane of the points of application of force to another during the actuation does not take place. The height difference between the two actuation planes that are specified in the cited printed publication EP 1 121 700 B2, does not change.

It is characterizing for EP1 121 700 B2 that only a single actuation plane of the actuator is associated with each, the actuation of the normally closed contacts and the actuation of the normally open contacts, and therefore one contact type (normally closed or normally open) is assigned to each actuation plane. One distance, the distance between actuation plane 1 and the point of fixation of the spring, is associated with the normally open contact and the other distance, between actuation plane 2 and the point of fixation of the spring is associated with the normally closed contact.

SUMMARY

The problem addressed by the present invention is therefore that of improving a relay having a modified force-displacement characteristic of the kind mentioned at the beginning, in such a way that an improved and also variable matching of the contact-set characteristic to a drive characteristic of a drive system of a relay is possible.

To solve this problem, the invention provides a method for operating an electromagnetic relay comprising at least one contact-set support in which a plurality of contact springs are fixed at the base end and, in pairs, form normally open and/or normally closed contacts, wherein at least one actuator acts on the respective active contact springs, the actuator being movably driven in the longitudinal direction thereof by a magnet system and having actuating surfaces for acting on the respective contact spring to be actuated, wherein during the stroke of the actuator a change-over from one actuation plane to another actuation plane takes place on the active contact springs.

It is an essential feature of the invention that during the stroke of the actuator, the actuation of the active contact springs transitions from a first actuation plane to a second actuation plane. Owing to the design of the surface between the two actuation planes of the actuator, a discontinuous (abrupt) transition from plane 1 to plane 2 can be rendered continuous.

The present technical teaching additionally provides the advantage that a continuous transition from one actuation plane to the other actuation plane can be achieved due to the fact that the invention provides that each of the cams of the actuator that are associated with the active springs each has an actuating surface that not only forms, in the direction of actuation of the actuator, an angle relative to the direction of travel of the actuator, but is additionally provided with a curvature.

This achieves that the actuator bears with an actuating surface bearing obliquely relative to the point of engagement on the spring to be actuated against the contact spring to be actuated, such that as the actuator travel of the actuator continues, the spring to be actuated is first engaged and actuated at the upper end thereof (plane 1)—a great distance from the point of fixation thereof—and that during this actuator travel, the point of application of force, owing to the actuating surface being designed to be inclined, moves in a downward direction, toward the point of fixation of the spring (plane 2).

As the deflection of the actuated spring increases, the actuator now acts with the inclined cam thereof further down on the spring to be actuated. Thus, the point of force application is shifted during the movement of the actuator and action on the active spring to be actuated, from an upper point (plane 1) to a lower point (plane 2), said shifting of the point of force application preferably being continuous.

Depending on the design of the surfaces of the cams between the two operating planes, the transition from plane 1 to plane 2 can occur abruptly (discontinuous) or be rendered continuous.

With a curved surface on the respective cam, there is no abrupt change-over from an upper to a lower point of application of force on the active spring, hut rather the points of application of force move nearly continuous along the contact spring during the movement of the actuator, from an upper point of application of force (plane 1) toward a lower point of application of force (plane 2).

The term "nearly continuous" means that the longitudinal movement of the actuating surface on the actuator occurs (as) interruption-free (as possible) along the length of the contact spring. In the prior art, such a transition from one actuation plane to the other along the length of the contact spring does not exist. The prior art does not change actuation planes.

This creates the advantage over EP1 121 700 B2, that no choppy contact-set characteristic is generated, but instead a continuous contact-set characteristic is attained, which may be formed in a first embodiment of continuous, relatively straight curve branches, and in a second embodiment of curve branches that are nearly curved, so as to permit an even better rounded shape of the contact-set characteristic.

All of the above definitions apply to the embodiment shown in FIG. 8, in which the drive characteristic and a contact-set characteristic according to the prior art are compared to a contact-set curve according to the invention.

In a preferred embodiment of the invention, it is provided that the cams of the actuator that form the actuating surfaces are at an angle to the vertical, with the proviso that it is assumed that the actuator operates in a horizontal direction.

The size of the angle of the actuating surface to the vertical determines the travel point of transition from the upper point of application of force to the lower point of application of force.

In a first embodiment of the invention it is provided that this actuating surface that is inclined at an angle is designed to be straight in itself.

In another embodiment of the invention it is provided that this actuating surface is designed to be convex. This means that the contact-set characteristic effected thereby is formed not of continuous straight curve branches—as in the case of a straight actuating surface—but that such a contact-set characteristic additionally has rounded curve branches.

Owing to the attainment of rounded contact-set characteristic curve branches, an even more continuous transition from one state of the contact springs to the other state is achieved, without the risk that unstable switching states could occur in the intermediate path between these two contact states.

The subject matter of the present invention derives not only from the subject matter of the individual claims but also from the individual claims taken in combination with each other.

All of the details and features disclosed in the documents, including in the Abstract, and in particular the physical embodiment illustrated in the drawings, are claimed as essential to the invention in so far as they are novel, whether separately or in combination, with respect to the prior art.

BRIEF DESCRIPTION OF THE DRAWINGS

The invention will now be described in detail with reference to drawings illustrating a number of ways of carrying out the invention. Further features essential to the invention and advantages of the invention will be apparent from the drawings and from their description.

In the drawings.

DETAILED DESCRIPTION

Figure 1:
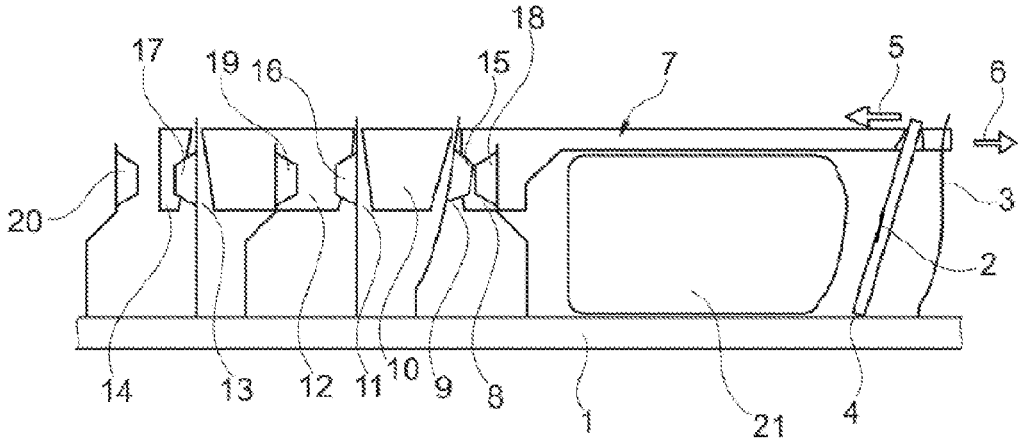
FIG. 1 shows a schematized section through a relay according to the invention in the normal state.

FIGS. 1 to 4 generally show an electromagnetically actuated relay, in which the individual contacts may be provided in pairs or as single contacts. According to FIG. 2, for example, a normally open contact 22, a further normally open contact 23 and one normally closed contact 24 are present, all of which are jointly actuated by one actuator 7. The actuator 7 is moved in the direction of arrow 5 in the operating state thereof and retracted into the normal state thereof in the direction of arrow 6 by a spring 3 engaging the rearward end thereof.

The actuator 7 is driven by an armature 2 that is pivot-mounted in a pivot bearing 4 in the region of a contact set support 1. The armature 2 is driven by a drive coil 21 in the direction of arrow 5.

In the embodiment shown, the actuator 7 is made up of a flat insulating material and forms cams 8, 10, 12, 14 disposed one behind the other, with a slot 9, 11, 13 arranged therebetween in each case.

In the slot 9 in front of the cam 8, the active contact spring 15 is arranged, which bears under the natural tension thereof against the associated passive contact spring 18 and forms in the normal state the normally closed contact 24.

Conversely, the active contact spring 16 forms a normally open contact 23 together with the passive contact spring 19, the movement of the active contact spring 16 being is effected by the cam 12 and by an actuating surface 26 to be described later.

Figure 3:
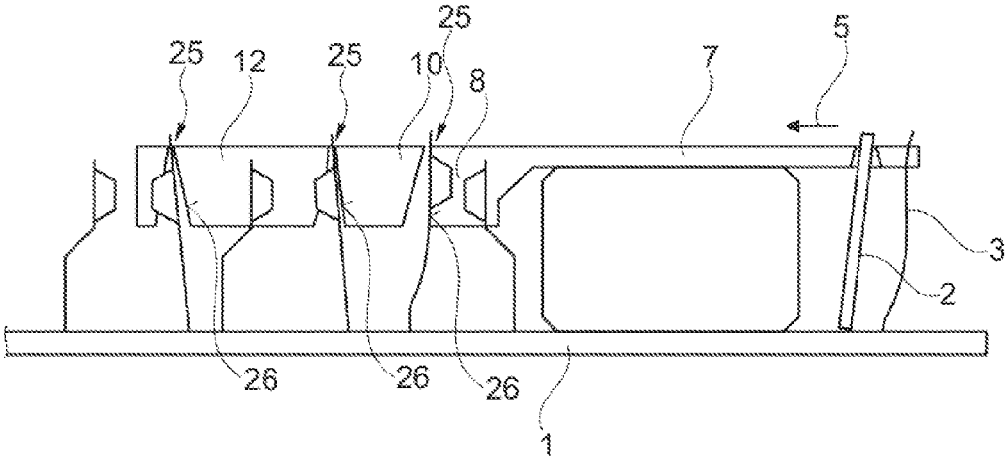
FIG. 3 shows the relay according to FIGS. 1 and 2 in an intermediate state.

Lastly, the normally open contact 22 is formed by the active contact spring 17 which, in the normal state shown, is arranged at a distance from the passive contact spring 20. FIG. 3 shows an intermediate state of the movement of the actuator 7 in the direction of arrow 5, while FIG. 4 shows the fully dosed energized state of the relay.

Figure 2:
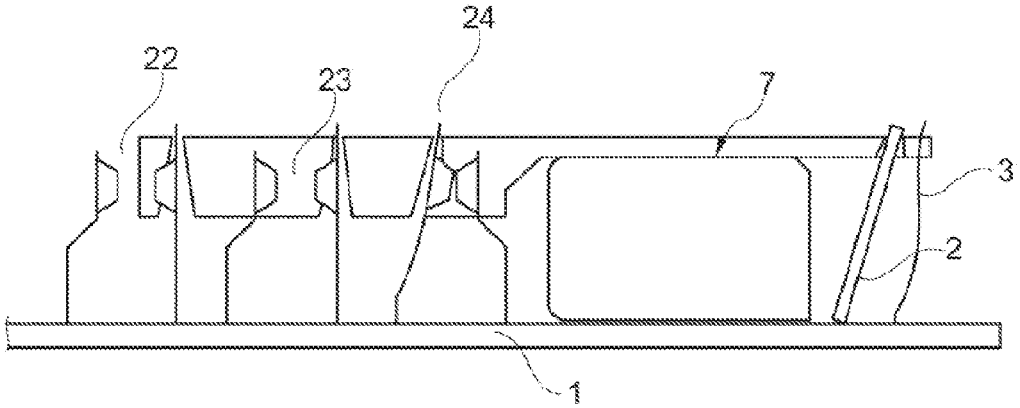
FIG. 2 shows the relay of FIG. 1 in the normal state, with further details shown.

From the comparison of FIG. 3 with FIGS. 1 and 2, it is apparent that, due to the actuating surface 26 on the cams 8, 10, 12, 14 being designed to be inclined, first an upper point of force application 25 of the actuator is defined that acts on the upper free end of the respective active contact spring 15, 16, 17.

Figure 4:
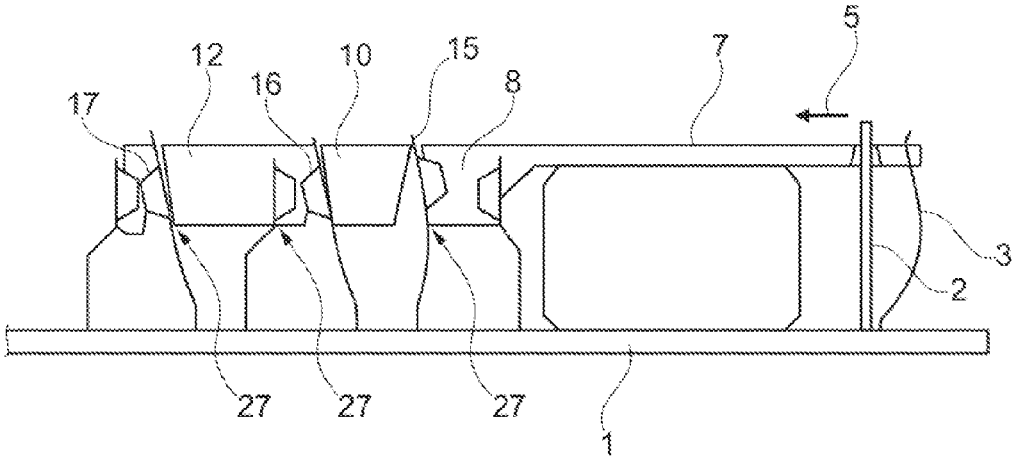
FIG. 4 shows the relay according to FIGS. 1 to 3 in the energized state.

As the movement of the actuator 7 continues in the direction of arrow 5, the energized state of FIG. 4 is reached and it is apparent that the point of force application 25 has shifted downward into the point of force application 27.

According to the invention it is thus shown that owing to an actuating surface 26 of the actuator that is oriented obliquely to the vertical 35, and which, together with the vertical 35 forms an angle 36 (see FIG. 6), a shifting of the point of force application 25 to the point of force application 27 located vertically below the former, is effected along the contact spring.

On actuation of the contact spring in the upper point of force application 25, a relatively small actuating force of the drive system is required while, on actuation of the respective contact spring 15-17, the points of force application 27 moving toward the point of fixation require a higher actuating force of the drive system.

Figure 5:
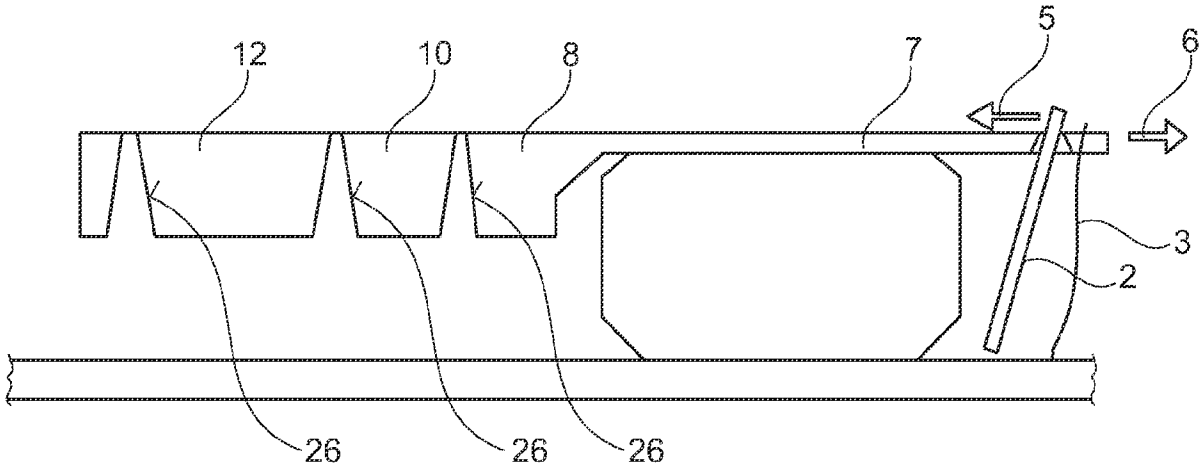
FIG. 5 shows the relay according to FIG. 1 in the normal state, without the contact springs.

FIG. 5 accordingly shows an actuator according to the invention having actuating surfaces 26 inclined obliquely to the vertical. Moreover, it is not essential to the solution that the actuating surfaces 26 on the cams 8, 10, 12 that actuate the active contact springs 15-17 are designed to be identically inclined. They can have differing inclines or shapes.

Figure 6:
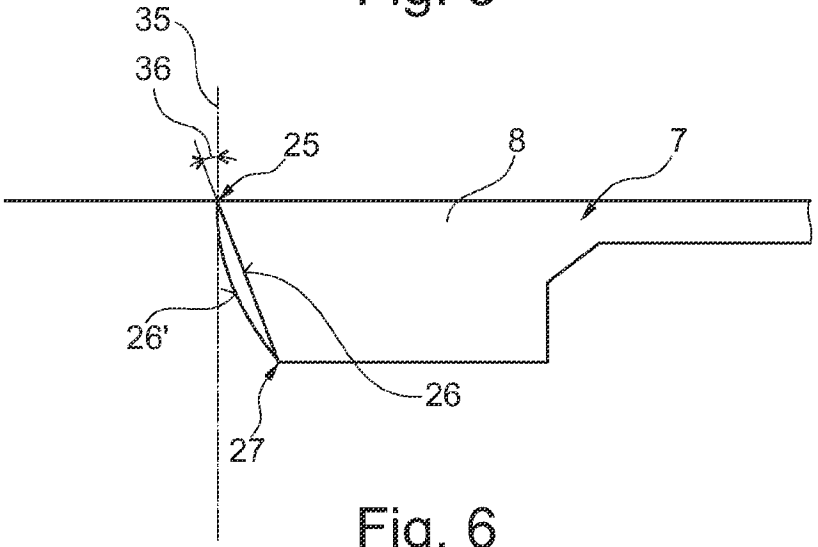
FIG. 6 shows an enlarged view of an actuating surface on the actuator in two different embodiments.

In the embodiment of FIG. 6, it is shown that instead of an actuating surface 26 that is designed to be straight and inclined at an angle 36 to the vertical 35, a cambered actuating surface 26' can be used that is designed to be convex, for example.

Through the use of such a convex actuating surface 26', rounded curve branches are achieved in the force-displacement diagram according to FIG. 8, as will be explained below.

Figure 7:
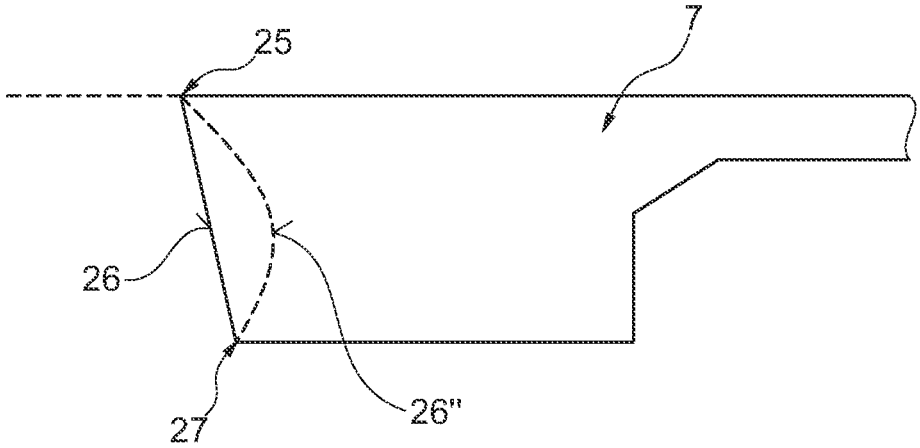
FIG. 7 shows a third embodiment of the design of the actuating surface on an actuator.

FIG. 7 shows that, instead of an actuating surface 26' that is designed to be convex, it is possible to use an actuating surface 26" that is designed to be concave, which means that the surfaces 26" do not come into engagement with the respective spring, but that merely, on movement of the actuator 7 in the direction of arrow 5, the engagement at the upper point of force application 25 immediately jumps to the action onto the lower point of force application 27, without there being a transition in this case.

Figure 8:
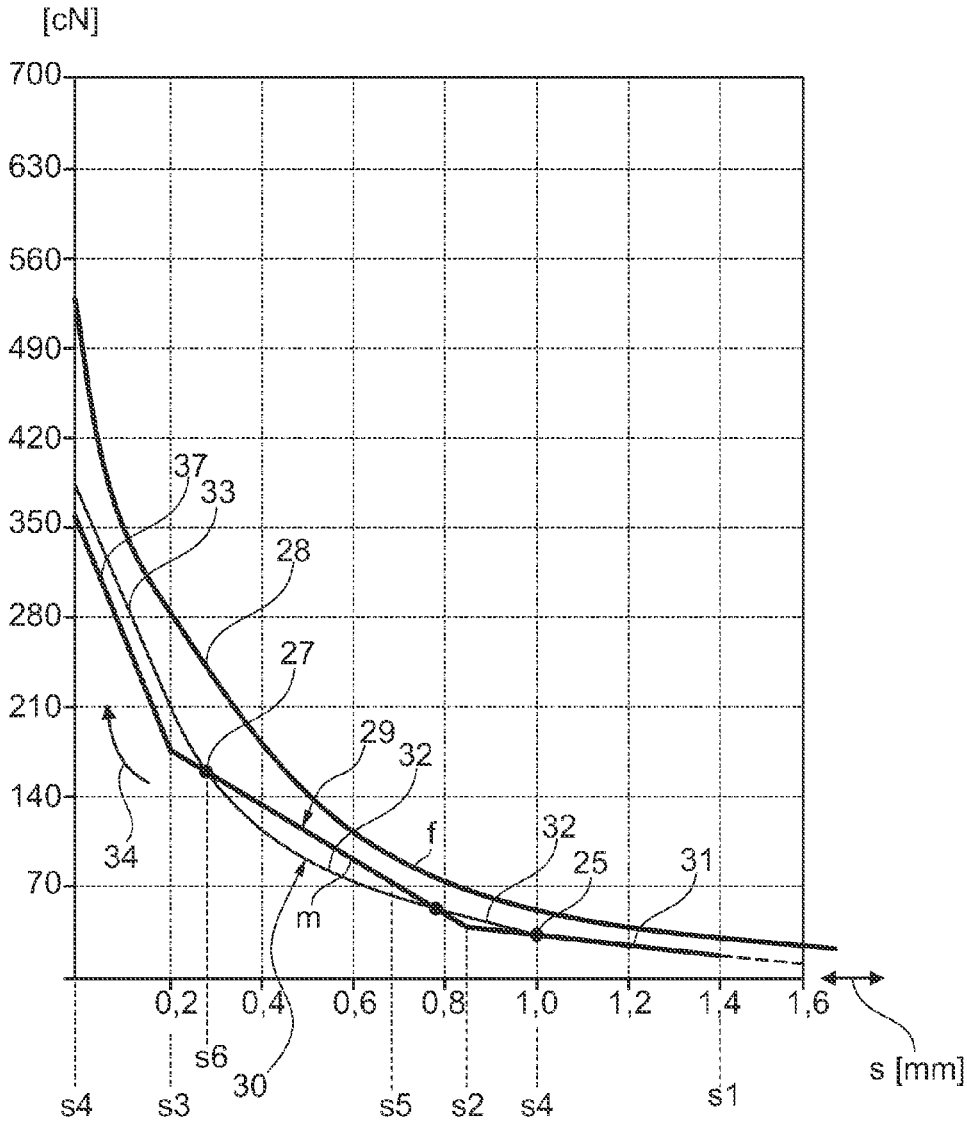
FIG. 8 shows the force-displacement characteristic of a drive system according to the prior art in a comparison with a contact-set characteristic according to the invention.

FIG. 8 shows the advantages of the invention over the prior art.

A force-displacement diagram is plotted, the plotted number values being intended merely as examples. They are in no way limiting to the present invention.

It is essential that, in a relay having a coil drive system, an approximately curved drive characteristic 28 is achieved at all times, which is designated by the letter f and is part of the prior art.

Furthermore, FIG. 8 shows that it is part of the prior art that discontinuous curve branches 31, 29, 37 form a contact-set characteristic according to the prior art. However, it is a disadvantage in the case of such a contact-set characteristic having discontinuous straight curve branches, that an abrupt transition during actuation of the individual active contact springs 15-17 must be accepted, which is undesirable.

This is where the invention sets in which, by virtue of the specifically designed actuating surface 26 on the cams 8, 10, 12 of the actuator 7 instead proposes continuous curve branches.

On initial actuation of the actuator 7, the curve branch 31 is generated that is part of the prior art. This is where the actuation of the active contact spring 15-17 at the upper point of force application 25 at the point s4 begins. As a result, a straight or slightly inclined curve branch 32 is attained, which is referred to as a whole as contact-set characteristic 30 according to the invention.

It is characteristic that between the points of s5 and s6 a straight, or—in the case of a convex actuating surface—a curved curve branch 32 is attained that has a substantially greater distance from the existing drive characteristic 28 and thereby ensures stable state switching of the contact springs.

In point s6 the upper point of force application 27 takes effect, and then, as the movement progresses along the contact-set characteristic 30, branches in point s6 into the steeper curve branch 33.

From the comparison of the contact-set characteristic 29 that is part of the prior art, with the contact-set characteristic 30 that is part of the invention, it is apparent that a simple modulation or influencing of the contact-set characteristic can be achieved with much less effort, namely simply by modifying the actuating surfaces on the cams 8, 10, 12 of the actuator 7. This was not previously possible with the prior art.

DRAWING LEGEND

1 contact-set support
2 armature
3 spring
4 pivot joint
5 direction of arrow
6 direction of arrow
7 actuator
8 cam
9 slot
10 cam
11 slot
12 cam
13 slot
14 cam
15 active contact spring
16 active contact spring
17 active contact spring
18 passive contact spring
19 passive contact spring
20 passive contact spring
21 drive coil
22 normally open contact
23 normally open contact
24 normally closed contact
25 point of force application (upper)
26 actuating surface cam 10, 12, 14)
27 point of force application (lower)
28 drive characteristic
29 contact-set characteristic (prior art)
30 contact-set characteristic (invention)
31 curve branch (of 30)
32 curve branch
33 curve branch
34 direction of arrow
35 vertical
36 angle
37 curve branch

What is claimed is:

1. A method for operating an electromagnetic relay comprising at least one contact-set support (1), a plurality of contact springs (15-20) having a base end fixed to the at least one contact-set support, said plurality of contact springs comprising a plurality of passive contact springs (18-20) and a plurality of active contact springs (15-17), pairs of which form normally open and/or normally closed contacts (22-24), wherein at least one actuator (7) acts on respective ones of the active contact springs (15-17), said actuator (7) being movably driven in the longitudinal direction thereof by a magnet system (2, 3, 4) and having actuating surfaces (26) for acting on the respective ones of the plurality of active contact springs (15-17) to be actuated, the actuation surfaces (26) of the actuator (7) assigned to each of the active contact springs form an angle (36) in direction of actuation of the actuator (7), the method comprising during the stroke of the actuator (7) causing an actuation plane on which the actuator (7) acts on the active contact springs (15-17) to change from one actuation plane (25) to another actuation plane (27), wherein the shifting of a point of force application during the stroke of the actuator and action on the plurality of active springs (15-17) to be actuated, is moved from an upper point of force application to a lower point of force application.

2. A method according to claim 1, wherein the the shifting of a point of force application during the stroke of the actuator and action on the plurality of active springs (15-17) to be actuated, from the upper point of force application to the lower point of force application is continuous.

3. A electromagnetic relay for carrying out the method according to claim 2, wherein the electromagnetic relay comprises at least one contact-set support (1), a plurality of contact springs (15-20) having a base end fixed to the at least one contact-set support, said plurality of contact springs comprising a plurality of passive contact springs (18-20) and a plurality of active contact springs (15-17) pairs of which form normally open and normally closed contacts (22-24), said plurality of contact springs comprising a plurality of passive contact springs (18-20) and a plurality of active contact springs (15-17), wherein at least one actuator (7) acts on respective ones of the active contact springs (15-17), said actuator (7) being movably driven in the longitudinal direction thereof by a magnet system (2, 3, 4) and having actuating surfaces (26) for acting on the respective ones of the plurality of active contact springs (15-17) to be actuated, wherein the actuating surfaces (26) of the actuator (7) that are associated with the respective plurality of active contact springs (15-17) are planar surfaces inclined at an angle (36) with respect to the longitudinal direction of actuation of the actuator (7).

4. A method according to claim 1, wherein the shifting of a point of force application during the stroke of the actuator and action on the plurality of active springs (15-17) to be actuated, from the upper point of force application to the lower point of force application occurs abruptly.

5. An electromagnetic relay for carrying out the method according to claim 4, wherein the electromagnetic relay comprises at least one contact-set support (1), a plurality of contact springs (15-20) having a base end fixed to the at least one contact-set support, said plurality of contact springs comprising a plurality of passive contact springs (18-20) and a plurality of active contact springs (15-17) pairs of which form normally open and normally closed contacts (22-24), said plurality of contact springs comprising a plurality of passive contact springs (18-20) and a plurality of active contact springs (15-17), wherein at least one actuator (7) acts on respective ones of the active contact springs (15-17), said actuator (7) being movably driven in the longitudinal direction thereof by a magnet system (2, 3, 4) and having actuating surfaces (26) for acting on the respective ones of the plurality of active contact springs (15-17) to be actuated, wherein at least one of the actuating surfaces (26) of the actuator (7) that are associated with the respective plurality of active contact springs (15-17) have a convex shape.

6. A electromagnetic relay for carrying out the method according to claim 1, wherein the electromagnetic relay comprises at least one contact-set support (1), a plurality of contact springs (15-20) having a base end fixed to the at least one contact-set support, said plurality of contact springs comprising a plurality of passive contact springs (18-20) and a plurality of active contact springs (15-17) pairs of which form normally open and normally closed contacts (22-24), said plurality of contact springs comprising a plurality of passive contact springs (18-20) and a plurality of active contact springs (15-17), wherein at least one actuator (7) acts on respective ones of the active contact springs (15-17), said actuator (7) being movably driven in the longitudinal direction thereof by a magnet system (2, 3, 4) and having actuating surfaces (26) for acting on the respective ones of the plurality of active contact springs (15-17) to be actuated, wherein the actuating surfaces (26) of the actuator (7) that are associated with the respective plurality of active contact springs (15-17) are planar surfaces inclined at an angle (36) with respect to the longitudinal direction of actuation of the actuator (7).

7. The relay according to claim 6, wherein at least two of the actuating surfaces (26) on the cams (8, 10, 12) of the actuator (7) that actuate the active contact springs (15-17) are identically inclined.

8. The relay according to claim 6, wherein at least two of the actuating surfaces (26) on the cams (8, 10, 12) actuating the active contact springs (15-17) are not identically inclined.

9. An electromagnetic relay for carrying out the method according to claim 1, wherein the electromagnetic relay comprises at least one contact-set support (1), a plurality of contact springs (15-20) having a base end fixed to the at least one contact-set support, said plurality of contact springs comprising a plurality of passive contact springs (18-20) and a plurality of active contact springs (15-17) pairs of which form normally open and normally closed contacts (22-24), said plurality of contact springs comprising a plurality of passive contact springs (18-20) and a plurality of active contact springs (15-17), wherein at least one actuator (7) acts on respective ones of the active contact springs (15-17), said actuator (7) being movably driven in the longitudinal direction thereof by a magnet system (2, 3, 4) and having actuating surfaces (26) for acting on the respective ones of the plurality of active contact springs (15-17) to be actuated, wherein at least one of the actuating surfaces (26) of the actuator (7) that are associated with the respective plurality of active contact springs (15-17) have a convex shape.

10. An electromagnetic relay comprising at least one contact-set support (1), a plurality of contact springs (15-20) having a base end fixed to the at least one contact-set support, said plurality of contact springs comprising a plurality of passive contact springs (18-20) and a plurality of active contact springs (15-17) pairs of which form normally open and normally closed contacts (22-24), wherein at least one actuator (7) acts on respective ones of the active contact springs (15-17), said actuator (7) being movably driven in the longitudinal direction thereof by a magnet system (2, 3, 4) and having actuating surfaces (26) for acting on the respective ones of the plurality of active contact springs (15-17) to be actuated, wherein the actuating surfaces (26) of the actuator (7) that are associated with the respective plurality of active contact springs (15-17) form an angle (36) with respect to the longitudinal direction of actuation of the actuator (7) and wherein the shifting of a point of force application during the stroke of the actuator and action on the plurality of active springs (15-17) to be actuated, is moved from an upper point of force application to a lower point of force application.

11. The relay according to claim 10, wherein the respective actuating surfaces (26) of the actuator (7) are designed in the form of cams (10, 12, 14).

12. The relay according to claim 10, wherein at least two of the actuating surfaces (26) on the cams (8, 10, 12) of the actuator (7) that actuate the active contact springs (15-17) are identically inclined.

13. The relay according to claim 10, wherein at least two of the actuating surfaces (26) on the cams (8, 10, 12) actuating the active contact springs (15-17) are not identically inclined.

* * * * *